US007926470B2

(12) United States Patent
Lockridge et al.

(10) Patent No.: US 7,926,470 B2
(45) Date of Patent: Apr. 19, 2011

(54) COMPACT RELIEF VALVE HAVING DAMPING FUNCTIONALITY

(75) Inventors: Donald J. Lockridge, Lafayette, IN (US); Aaron C. Luft, Frankfort, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/421,345

(22) Filed: Apr. 9, 2009

(65) Prior Publication Data

US 2009/0255512 A1 Oct. 15, 2009

Related U.S. Application Data

(60) Provisional application No. 61/071,078, filed on Apr. 11, 2008.

(51) Int. Cl.
*F02M 37/00* (2006.01)

(52) U.S. Cl. ..... 123/510; 123/514; 123/516

(58) Field of Classification Search ..... 123/510, 123/511, 514, 516
See application file for complete search history.

(56) References Cited

U.S. PATENT DOCUMENTS

| | | | | |
|---|---|---|---|---|
| 362,298 | A | 5/1887 | McElroy et al. | |
| 501,437 | A | 7/1893 | Pierce | |
| 1,036,479 | A | 8/1912 | Flamm | |
| 1,532,326 | A | 4/1925 | Lent et al. | |
| 1,994,320 | A | 3/1935 | McLaughlin | |
| 2,057,624 | A | 10/1936 | Burkhart | |
| 2,318,962 | A | 5/1943 | Parker | |
| 4,423,751 | A * | 1/1984 | Roettgen | 137/557 |
| 5,078,167 | A * | 1/1992 | Brandt et al. | 137/549 |
| 5,307,782 | A * | 5/1994 | Davis | 123/510 |
| 5,636,616 | A * | 6/1997 | Okane et al. | 123/514 |
| 5,649,561 | A * | 7/1997 | Brandt | 137/115.13 |
| 6,007,711 | A * | 12/1999 | Atwood | 210/136 |
| 6,220,228 | B1 * | 4/2001 | Atkins | 123/510 |
| 6,247,486 | B1 * | 6/2001 | Schwegler et al. | 137/115.27 |
| 6,520,162 | B1 * | 2/2003 | Schueler | 123/510 |
| 6,837,219 | B2 | 1/2005 | York et al. | |
| 7,025,048 | B2 * | 4/2006 | Ekstam | 123/516 |
| 7,150,270 | B2 * | 12/2006 | Hoffmann et al. | 123/514 |
| 7,192,518 | B2 * | 3/2007 | Roesgen | 210/149 |
| 7,343,901 | B2 | 3/2008 | Mori et al. | |
| 7,444,990 | B1 * | 11/2008 | Fisher et al. | 123/459 |
| 7,594,499 | B2 * | 9/2009 | Suzuki et al. | 123/446 |
| 7,634,986 | B2 * | 12/2009 | Kuroda et al. | 123/457 |
| 7,640,919 | B1 * | 1/2010 | Smith | 123/511 |
| 2008/0022974 | A1 | 1/2008 | Stockner et al. | |
| 2008/0202478 | A1 * | 8/2008 | Mohring et al. | 123/514 |
| 2009/0013972 | A1 * | 1/2009 | Wilson et al. | 123/514 |

FOREIGN PATENT DOCUMENTS

| | | |
|---|---|---|
| GB | 2116293 | 9/1983 |

* cited by examiner

*Primary Examiner* — Thomas N Moulis
(74) *Attorney, Agent, or Firm* — Finnegan, Henderson, Farabow, Garrett & Dunner LLP

(57) ABSTRACT

A relief valve is provided for use with a fuel system. The relief valve may have a housing forming an inlet, an outlet, and a central bore fluidly connecting the inlet to the outlet. The relief valve may also have a valve element disposed within the central bore of the housing and being configured to move between a flow-passing position and a flow-blocking position. The valve element may have a passageway continuously communicating the inlet of the housing with the outlet of the housing. The relief valve may also have a resilient member situated to bias the valve element toward the flow-blocking position.

20 Claims, 2 Drawing Sheets

COMPACT RELIEF VALVE HAVING DAMPING FUNCTIONALITY

RELATED APPLICATIONS

This application claims priority to, and the benefit of, U.S. Provisional Patent Application No. 61/071,078, to COMPACT RELIEF VALVE HAVING DAMPING FUNCTIONALITY, filed Apr. 11, 2008, the entire disclosure of which is fully incorporated herein by reference.

TECHNICAL FIELD

The present disclosure is directed to a relief valve and, more particularly, to a compact relief valve having damping functionality.

BACKGROUND

Many different fuel systems are utilized to introduce fuel into the combustion chambers of an engine. One type of fuel system is known as the common rail system. A typical common rail system utilizes one or more fuel filters to remove contaminants from the fuel and one or more pumping mechanisms to pressurize fuel and direct the pressurized fuel to a common manifold also known as the rail. Individual injectors draw pressurized fuel from the common rail and inject the fuel into the combustion chambers. In order to optimize operation of the engine, fuel pressure is controlled within a desired pressure range by controlling the pumping mechanisms. At times, however, pressure fluctuations or spikes may still occur. Without intervention, these pressure spikes could damage fuel system components and/or degrade fuel system performance.

One way to protect the fuel system from undesired pressure fluctuations and degraded system performance includes selectively relieving the system of fuel and/or air by way of one or more relief valves. An example of this protection method is disclosed in U.S. Pat. No. 7,343,901 (the '901 patent) issued to Mori et al., on Mar. 18, 2008. The '901 patent describes a common rail fuel system having a fuel filter located downstream of a feed pump to filter fuel drawn from a tank by the feed pump and discharged to a high pressure pump. Fuel from the high pressure pump is directed to at least one injector by way of a common rail. A relief valve is located on an outlet side of the feed pump and opens if the fuel pressure applied to the fuel filter exceeds a predetermined value. When the relief valve opens, a part of the fuel discharged by the feed pump is returned to the fuel tank. Thus, excessive fuel pressure can be prevented from acting on the fuel filter.

The relief valve of the '901 patent has a valve chamber, a ball valve, and a spring. The valve chamber is formed above an air collection chamber of the fuel filter. The ball valve is located within the valve chamber to open or close a communication hole that connects the valve chamber to the air collection chamber. The spring biases the ball valve in a valve-closing direction. Thus, when fuel pressure acting on the fuel filter exceeds the biasing force of the spring, the ball valve opens the communication hole. Accordingly the fuel pressure acting on the fuel filter is released through the relief valve, and the air collected within the air collection chamber of the fuel filter is bled away.

Although the relief valve of the '901 patent may sufficiently protect fuel system components by relieving excessive pressures, it may be problematic. In particular, a seat against which a ball of the ball valve seals must be manufactured to tight tolerances and often requires grinding and polishing processes. These tight tolerances and complicated manufacturing processes can significantly increase the cost of a system employing the ball valve. In addition, the opening and closing of the ball valve may create undesired pressure fluctuations within the system. Furthermore, the system must include an air collection chamber for periodic bleeding of air from the fuel filter. Still further, pressure pulses from the high pressure pump may not be adequately dampened.

The disclosed relief valve is directed to overcoming one or more of the problems set forth above.

SUMMARY

One aspect of the present disclosure is directed to a relief valve. The relief valve may include a housing forming an inlet, an outlet, and a central bore fluidly connecting the inlet to the outlet. The relief valve may also include a valve element disposed within the central bore of the housing and being configured to move between a flow-passing position and a flow-blocking position. The valve element may have a passageway continuously communicating the inlet of the housing with the outlet of the housing. The relief valve may also include a resilient member situated to bias the valve element toward the flow-blocking position.

Another aspect of the present disclosure is directed to a fuel system. The fuel system may include a supply of fuel, a source configured to pressurize the fuel, and at least one injector configured to receive pressurized fuel from the source. The fuel system may also include a filter assembly located between the supply of fuel and the source, and a relief valve associated with the filter assembly. The filter assembly may include a primary filter, a secondary filter, and a tertiary filter. The relief valve may be configured to continuously fluidly communicate the filter assembly with the supply of fuel and to selectively relieve fuel and air from the filter assembly to the supply of fuel. The relief valve may be fluidly connected between an outlet of the secondary filter and an inlet of the tertiary filter.

Yet another aspect of the present disclosure is directed to a method of operating a fluid system. The method may include drawing fluid from a low pressure supply, pressurizing the fluid, and passing the pressurized fluid through a filter assembly. The method may also include selectively relieving pressurized fluid from the filter to the low pressure supply via a relief valve associated with the filter assembly and continuously passing fluid from the filter assembly to the low pressure supply via the relief valve.

DETAILED DESCRIPTION

Figure 1:
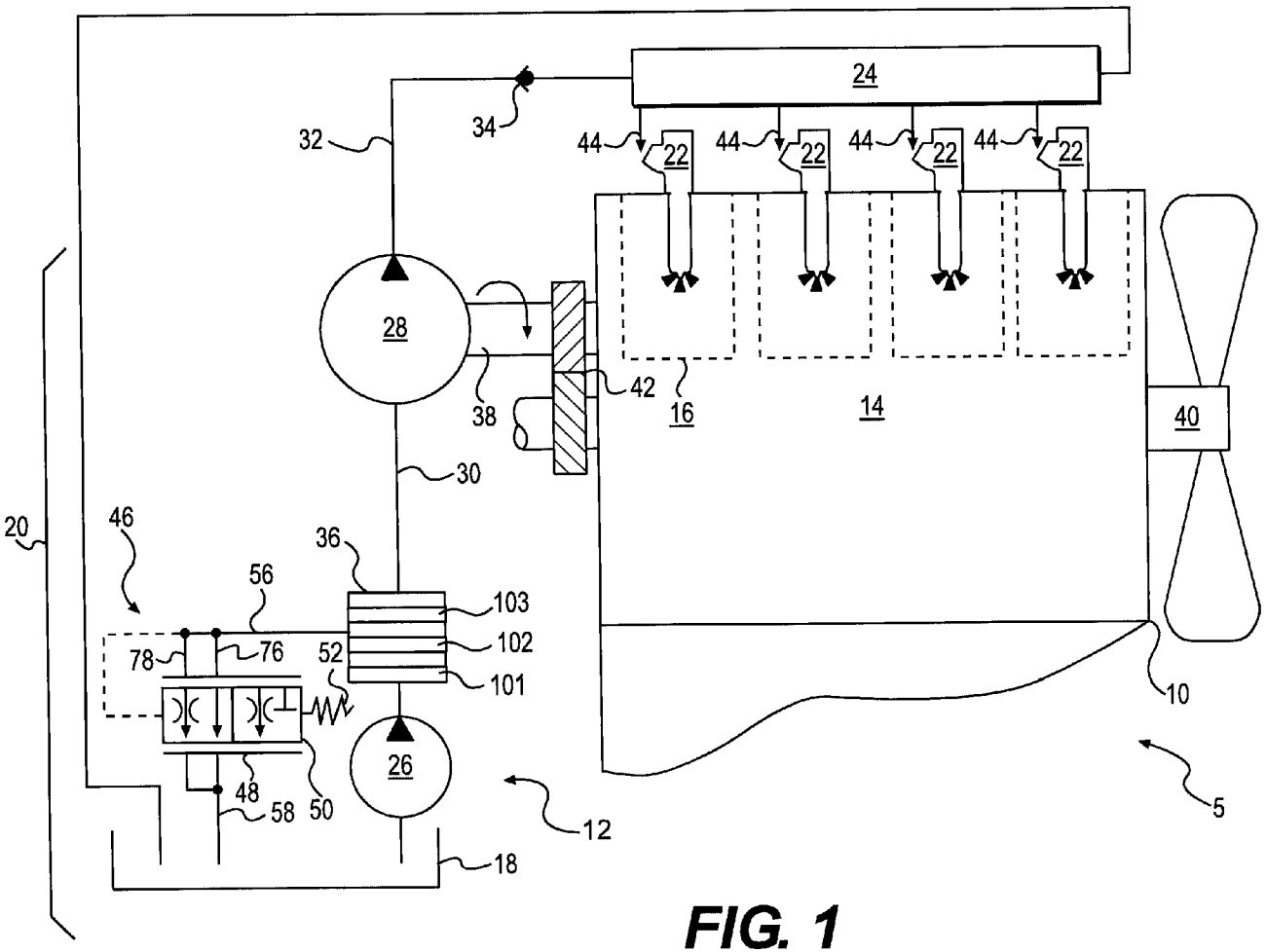
FIG. 1 is a schematic illustration of an exemplary disclosed power system.

FIG. 1 illustrates a power system 5 having an engine 10 and a fuel system 12. For the purposes of this disclosure, engine 10 is depicted and described as a four-stroke diesel engine. One skilled in the art will recognize, however, that engine 10 may be any other type of internal combustion engine such as, for example, a gasoline or a gaseous fuel-powered engine. Engine 10 may include an engine block 14 that at least partially defines a plurality of combustion chambers 16. In the illustrated embodiment, engine 10 includes four combustion chambers 16. However, it is contemplated that engine 10 may include a greater or lesser number of combustion chambers 16 and that combustion chambers 16 may be disposed in an "in-line" configuration, a "V" configuration, or in any other suitable configuration.

Fuel system 12 may include components that cooperate to deliver injections of pressurized fuel into each combustion chamber 16 of engine 10. In one embodiment, fuel system 12 may be a common rail fuel system. As such, fuel system 12 may include a tank 18 configured to hold a low pressure supply of fuel, a fuel pumping arrangement 20 configured to pressurize the fuel and direct the pressurized fuel to one or more fuel injectors 22 by way of a manifold or common rail 24.

Fuel pumping arrangement 20 may include one or more pumping devices that function to increase the pressure of the fuel directed to common rail 24. In one example, fuel pumping arrangement 20 includes a low pressure source 26 and a high pressure source 28 disposed in series and fluidly connected by way of a fuel line 30. Low pressure source 26 may be a transfer or feed pump configured to provide low pressure feed to high pressure source 28. High pressure source 28 may be configured to receive the low pressure feed and to increase the pressure of the fuel up to about 300 MPa or higher. High pressure source 28 may be connected to common rail 24 by way of a fuel line 32. A check valve 34 may be disposed within fuel line 32, if desired, to provide for a unidirectional flow of fuel from fuel pumping arrangement 20 to common rail 24. A filter assembly 36 may be disposed within fuel line 30 to remove debris, air, and/or water from the fuel pressurized by fuel pumping arrangement 20. The filter assembly 36 may include one or more filters, such as a primary filter 101, a secondary filter 102, and/or a tertiary filter 103. The tertiary filter 103 (and, in some cases, the secondary filter 102) may be configured to provide finer filtration than the primary filter 101.

One or both of low and high pressure sources 26, 28 may be operatively connected to and driven by engine 10. Low and/or high pressure sources 26, 28 may be connected with engine 10 in any manner readily apparent to one skilled in the art where a rotation of engine 10 will result in a corresponding rotation of a pump drive shaft. For example, a pump drive-shaft 38 of high pressure source 28 is shown in FIG. 1 as being connected to a crankshaft 40 through a gear train 42. It is contemplated, however, that one or both of low and high pressure sources 26, 28 may alternatively be driven electrically, hydraulically, pneumatically, or in any other appropriate manner.

Fuel injectors 22 may be disposed within cylinder heads (not shown) of engine 10 and connected to common rail 24 by way of a plurality of fuel lines 44. Each fuel injector 22 may be operable to inject an amount of pressurized fuel into an associated combustion chamber 16 at predetermined timings, fuel pressures, and fuel flow rates.

During operation of engine 10, it may be possible for the fuel pressures within fuel system 12 to deviate from a desired pressure. For example, the high pressure source 28 may cause undesired pressure pulses or spikes with the system. If unaccounted for, these deviations could result in undesired performance or even damage to the components of power system 5. To help maintain the desired pressure within fuel system 12, a relief valve 46 may be provided and associated with filter assembly 36. In one embodiment, relief valve 46 may be located between an outlet of a secondary filter 102 and an inlet of a tertiary filter 103. In this configuration, when a pressure of the fuel within the secondary filter 102 exceeds an opening pressure of relief valve 46, fuel and/or air from within the secondary filter 102 may be relieved to tank 18.

Furthermore, pressure pulses with in the fuel system 12, such as, for example, from the high pressure source 28, may cause filtering inefficiency. Placing the relief valve 46 between the outlet of the secondary filter 102 and the inlet of the tertiary filter 103 may prevent filtering efficiency in the primary and secondary filters 101, 102 caused by pressure pulses from the high pressure source 28. Furthermore, since the relief valve 46 relieves fuel back to the tank 18, all the fuel from the low pressure source 26 is filtered by the primary and secondary filters 101, 102 but not the tertiary filter 103 when the relief valve is open. Since the tertiary filter 103 does not see all of the fuel from the low-pressure source, the life of tertiary filter 103 may be extended versus placing the relief valve downstream of the tertiary filter 103.

It is contemplated, however, that relief valve 46 may alternatively be located at an outlet of the tertiary filter 103, if desired. It is further contemplated that the relief valve 46 may function to alternatively or additionally relieve unfiltered fuel, if desired.

Figure 2:
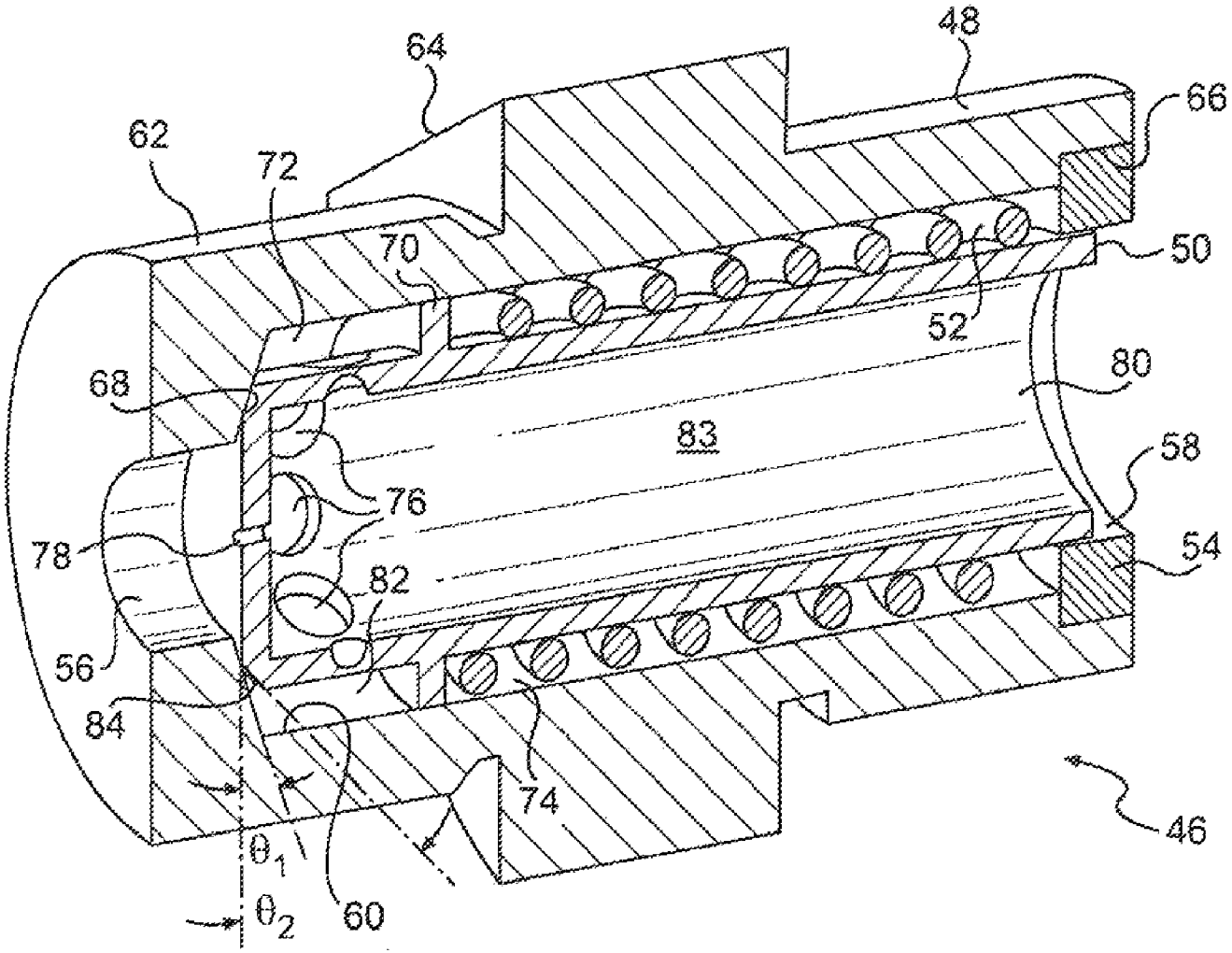
FIG. 2 is a cross-sectional illustration of an exemplary disclosed relief valve that may be used with the power system of FIG. 1.

In one embodiment, as shown in FIG. 2, relief valve 46 may be a cartridge type valve having a spool element. In particular, relief valve 46 may include a housing 48, a spool 50, and a resilient member 52, for example a return spring, that biases spool 50 from a flow-passing position toward a flow-blocking position within housing 48. A retention member 54, for example a C-clip, may be disposed within housing 48 to maintain spool 50 and/or resilient member 52 within housing 48. It should be noted that relief valve 46 could embody a non-cartridge type of valve with or without a spool element, if desired.

Housing 48 may be a generally hollow cylindrical member having an inlet 56, an outlet 58, and a central bore 60 fluidly connecting inlet 56 to outlet 58. In one example, a flow area of inlet 56 may be smaller than a flow area of outlet 58, which, in turn, may have a smaller flow area than central bore 60 (i.e., after restriction of outlet 58 by retention member 54). An annular recessed area 66 located at an outlet end of central bore 60 may be configured to receive retention member 54. At an opposing inlet end of central bore 60, housing 48 may include an internal valve seat 68 against which spool 50 may seal when in the flow-blocking position. In one embodiment, valve seat 68 may be a conical valve seat having a cone angle $\theta_1$.

Housing 48 may also include a means for connecting relief valve 46 to filter assembly 36. In one example, the means for connecting may include threads 62 externally located at the inlet end of housing 48, and an externally located tool engagement area 64. In this example, relief valve 46 may be connected to filter assembly 36 by manual engagement of a tool with area 64 and rotation thereof until threads 62 have fully engaged internal threads (not shown) of filter assembly 36.

Spool 50 may be disposed within central bore 60 and include a radially extending flange 70 that divides central bore 60 into a fluid chamber 72 at the inlet end of housing 48, and a spring chamber 74 that houses resilient member 52 at the outlet end of housing 48. Spool 50 may be a generally hollow cylindrical member having one or more first or main inlets 76, a second or dampening inlet 78, an outlet 80, and a central bore 83 connecting main inlets 76 and dampening inlet 78 to outlet 80. When disposed within housing 48, a clearance 82 may be maintained between an interior annular surface of housing 48 and an exterior annular surface of spool 50.

Main inlet 76 may be located within the exterior annular surface of spool 50 at the inlet end thereof to fluidly communicate clearance 82 with central bore 83 of spool 50. In one embodiment, spool 50 may include eight main inlets 76 arranged around a periphery of spool 50 at the inlet end in substantially equal intervals. When spool 50 is displaced away from valve seat 68 (i.e., moved to the flow-passing position shown in FIG. 1), fuel and/or air may be allowed to pass from filter assembly 36 through inlet 56 of housing 48, and through clearance 82 to main inlets 76. From main inlets 76, the fuel and/or air may pass through central bore 83 of spool 50 to exit relief valve 46 by way of outlets 80 and 58. However, when a conical sealing surface 84 of spool 50 engages valve seat 68 (i.e., when spool 50 is returned by resilient member 52 to the flow-blocking position shown in FIG. 2), fluid flow from inlet 56 of housing 48 to main inlets 76 may be inhibited (i.e., substantially blocked). Conical sealing surface 84 may have a cone angle $\theta_2$ that is greater than $\theta_1$, such that line contact at the engagement area may be achieved.

Dampening inlet 78 may be located at the inlet end of spool 50 and substantially aligned with a longitudinal axis (not shown) of central bores 83. Dampening inlet 78, however, may be located at any position in which it may allow fuel and/or air to continuously pass from inlet 56 of housing 48 through central bore 83 of spool 50, through outlet 58 of housing 48, and to tank 18. This continuous flow of fuel and/or air may help to dampen or otherwise reduce pressure fluctuations within filter assembly 36 caused by the movement of spool 50 within housing 48. For example, pressure pulses or spikes in the fuel system may result in undesired movement of the spool that can add additional pressure fluctuations to the system and cause valve wear (e.g. valve seat wear). The dampening inlet 78 may slow down and/or reduce movement of the spool, which may reduce pressure fluctuations and valve wear.

In addition, dampening inlet 78 may function to continuously bleed off air that has accumulated within filter assembly 36, even when the pressures within filter assembly 36 are below the opening pressure of relief valve 46. In one embodiment, dampening inlet 78 may be a restricted passageway (i.e., a passageway having a flow area smaller than that of inlet 56, central bore 60, and central bore 83), the restriction thereof helping to dissipate fluid energy associated with pressure fluctuations and/or spikes within fuel system 12.

INDUSTRIAL APPLICABILITY

Although intended for use with a common rail fuel system, the disclosed relief valve may have wide use in a variety of applications including, for example, non-common rail fuel systems, lubrication systems, implement actuation systems, transmission systems, and other hydraulic systems, where protection from excessive pressures is desired. The disclosed relief valve may provide protection from damaging pressures by selectively opening to relieve fluid (i.e., fuel and/or air) to a low pressure tank. In addition, the disclosed relief valve may minimize pressure fluctuations caused by its openings and closings by allowing a continuous flow of fluid to the low pressure tank. The operation of power system 5 will now be explained.

During operation of power system 5 (referring to FIG. 1), low pressure source 26 may draw fuel from tank 18, and transfer the fuel through filter assembly 36 to high pressure source 28. High pressure source 28 may then increase the pressure of the fuel and direct the pressurized fuel to injectors 22 by way of common rail 24.

As the pressure of the fuel within filter assembly 36 acting against the closed end of spool 50 exceeds the bias of resilient member 52, spool 50 may move toward the flow-passing position. At the flow-passing position, primarily fuel and some air from filter assembly 36 may pass through inlet 56 of housing 48 and main inlets 76 to tank 18 by way of central bore 83 and outlets 80 and 58. As the fuel and/or drains through relief valve 46 back to tank 18, the pressures within filter assembly 36 may reduce and spool 50 may be returned by resilient member 52 to the flow-blocking position (i.e., conical sealing surface 84 may be returned to engagement with valve seat 68). Throughout the operation of power system 5, primarily air and some fuel may be allowed to continuously pass from filter assembly 36 through relief valve 46 by way of dampening inlet 78. During startup of engine 10, the fluid passed both through dampening inlet and through main inlets 76 may be primarily air such that fuel system 12 may be properly vented and primed for operation.

The disclosed pressure relief valve may be a compact alternative to controlling pressure within a common rail fuel system. Specifically, because pressure relief valve 46 may combine the relieving of excessive pressures and the venting of accumulated air functions within a single valve, the packaging requirements and footprint of fuel system 12 may be small. In addition, the component geometry (i.e., the spool valve characteristics) of relief valve 46 may be simple and require only low cost machining. Further, the continuous flow of fuel and/or air through dampening inlet 78 may help reduce pressure fluctuations within fuel system 12.

It will be apparent to those skilled in the art that various modifications and variations can be made in the relief valve and fuel system of the present disclosure without departing from the scope of the disclosure. Other embodiments will be apparent to those skilled in the art from consideration of the specification and practice of the relief valve and fuel system disclosed herein. It is intended that the specification and examples be considered as exemplary only, with a true scope being indicated by the following claims and their equivalents.

What is claimed is:

1. A fuel system, comprising:
- a supply of fuel;
- a source configured to pressurize the fuel;
- at least one injector configured to receive pressurized fuel from the source;
  - a filter assembly located between the supply of fuel and the source, the filter assembly including a primary filter, a secondary filter, and a tertiary filter; and
  - a relief valve fluidly connected between an outlet of the secondary filter and an inlet of the tertiary filter, wherein the relief valve is configured to continuously fluidly communicate the filter assembly with the supply of fuel and to selectively relieve fuel and air from the filter assembly to the supply of fuel.

2. The fuel system of claim 1, wherein the relief valve relieves fuel and air from the filter assembly when the fuel pressure in the filter assembly exceeds a desired fuel pressure.

3. The fuel system of claim 1, wherein the relief valve includes:
- a housing forming an inlet and an outlet; and
- a valve element configured to move between a flow-passing position and a flow-blocking position, the valve element having a passageway that continuously communicates the inlet of the housing with the outlet of the housing.

4. The fuel system of claim 3, wherein the valve element is a spool.

5. A fuel system, comprising:
- a supply of fuel;
- a source configured to pressurize the fuel;
- at least one injector configured to receive pressurized fuel from the source;
- a filter assembly located between the supply of fuel and the source, the filter assembly;

a relief valve fluidly connected between an outlet of the secondary filter and an inlet of the tertiary filter, wherein the relief valve is configured to continuously fluidly communicate the filter assembly with the supply of fuel and to selectively relieve fuel and air from the filter assembly to the supply of fuel, wherein the relief valve includes a housing forming an inlet and an outlet; and a valve element configured to move between a flow-passing position and a flow-blocking position, the valve element having a passageway that continuously communicates the inlet of the housing with the outlet of the housing, wherein the valve element is a spool; and wherein the housing includes an interior conical seat formed at the inlet, the valve element being configured to engage the interior conical seat in the flow-blocking position.

6. The fuel system of claim 5, wherein the valve element has an exterior conical surface configured to engage the interior conical seat in the flow-blocking position.

7. The fuel system of claim 6, wherein a cone angle of the interior conical seat is greater than a cone angle of the exterior conical surface.

8. The fuel system of claim 3, wherein the valve element includes an exterior annular surface and at least one opening located within the exterior annular surface that fluidly communicates the inlet of the housing with the outlet of the housing when the valve element is in the flow-passing position.

9. The fuel system of claim 1, further including a common rail in communication with the source.

10. The fuel system of claim 1, further including a feed pump located between the supply of fuel and the filter assembly.

11. The fuel system of claim 1, wherein the relief valve is configured to threadingly engage the filter assembly.

12. The fuel system of claim 1, wherein the relief valve comprises:

a housing forming an inlet, an outlet, and a central bore fluidly connecting the inlet to the outlet;

a valve element disposed within the central bore of the housing and being configured to move between a flow-passing position and a flow-blocking position, the valve element including:

an exterior annular surface with a first inlet that fluidly communicates the inlet of the housing with the outlet of the housing when the valve element is in the flow-passing position;

a second inlet that continuously fluidly communicates the inlet of the housing with the outlet of the housing; and a radially extending flange positioned on the exterior annular surface; and a resilient member situated around the valve element, wherein the resilient member engages the flange to bias the valve element toward the flow-blocking position.

13. The fuel system of claim 12, wherein the valve element is movable between the flow-passing and flow-blocking positions in response to a pressure differential between the inlet of the housing and the outlet of the housing.

14. A method of operating a fluid system, comprising:

drawing fluid from a low pressure supply;

pressurizing the fluid;

passing the pressurized fluid through a filter assembly;

directing fluid from the filter assembly to the low pressure supply via a relief valve, the relief valve including a housing forming an inlet, an outlet, and a central bore fluidly connecting the inlet to the outlet, a valve element disposed within the central bore of the housing and being configured to move between a flow-passing position and a flow-blocking position, the valve element including:

an exterior annular surface with a first inlet that fluidly communicates the inlet of the housing with the outlet of the housing when the valve element is in the flow-passing position, a second inlet that continuously fluidly communicates the inlet of the housing with the outlet of the housing; and a radially extending flange positioned on the exterior annular surface; and a resilient member situated around the valve element, wherein the resilient member engages the flange to bias the valve element toward the flow-blocking position;

wherein directing fluid from the filter assembly to the low pressure supply via the relief valve includes selectively relieving pressurized fluid from the filter assembly to the low pressure supply via the first inlet of the valve element; and continuously passing fluid from the filter assembly to the low pressure supply via the second inlet.

15. The method of claim 14, wherein the fluid selectively relieved is primarily fuel, and the fluid continuously passed is primarily air.

16. The method of claim 14, wherein pressurizing the fluid includes pressurizing the fluid at a first location to a first pressure level, and increasing the pressure of the fluid at a second location to a second pressure level higher than the first pressure level.

17. The method of claim 14, wherein the step of selectively relieving pressurized fluid from the filter assembly to the low pressure supply is performed when the fluid is pressurized above a desired pressure level.

18. A relief valve, comprising:

a housing forming an inlet, an outlet, and a central bore fluidly connecting the inlet to the outlet;

a valve element disposed within the central bore of the housing and configured to move between a flow passing position and a flow blocking position, the valve element having a first passageway continuously communicating the inlet of the housing with the outlet of the housing, and wherein the valve element is a spool;

wherein the relief valve is configured to selectively relieve fluid from the inlet of the housing to the outlet of the housing by the valve element moving to the flow passing position;

wherein the housing includes an interior conical seat formed at the inlet, the valve element having an exterior conical surface configured to engage the interior conical seat in the flow-blocking position; and wherein a cone angle of the interior conical seat is greater than a cone angle of the exterior conical surface.

19. The relief valve of claim 18, wherein the valve element includes an exterior annular surface and at least one opening located within the exterior annular surface that fluidly communicates the inlet of the housing with the outlet of the housing when the valve element is in the flow-passing position.

20. The relief valve of claim 19, further comprising:

a radially extending flange positioned on the exterior annular surface; and a resilient member situated around the valve element, wherein the resilient member engages the flange to bias the valve element toward the flow-blocking position.

* * * * *